US008622265B2

(12) United States Patent
Arajakis

(10) Patent No.: US 8,622,265 B2
(45) Date of Patent: Jan. 7, 2014

(54) SLING SYSTEM

(75) Inventor: Michael M Arajakis, Boardman, OH (US)

(73) Assignee: GamePlan Gear LLC, Dubuque, IA (US)

( * ) Notice: Subject to any disclaimer, the term of this patent is extended or adjusted under 35 U.S.C. 154(b) by 0 days.

(21) Appl. No.: 13/343,704

(22) Filed: Jan. 4, 2012

(65) Prior Publication Data

US 2013/0126568 A1 May 23, 2013

Related U.S. Application Data

(60) Provisional application No. 61/430,158, filed on Jan. 5, 2011.

(51) Int. Cl.
*F41B 5/14* (2006.01)

(52) U.S. Cl.
USPC ..... 224/257; 224/327

(58) Field of Classification Search
None
See application file for complete search history.

(56) References Cited

U.S. PATENT DOCUMENTS 3,688,012 A * 8/1972 Vettel ..... 84/327
3,894,464 A * 7/1975 Brooks ..... 84/327
4,271,997 A * 6/1981 Michael ..... 224/546
4,911,347 A * 3/1990 Wilhite ..... 224/257
5,211,323 A * 5/1993 Chimenti et al. ..... 224/314
5,573,165 A * 11/1996 Bloemer et al. ..... 224/523
5,577,647 A * 11/1996 Pittarelli et al. ..... 224/148.6
5,692,654 A * 12/1997 Bell ..... 224/150
5,730,341 A * 3/1998 Hester, Jr. ..... 224/257
5,775,555 A * 7/1998 Bloemer et al. ..... 224/531
5,996,870 A * 12/1999 Shaver ..... 224/532
6,286,738 B1 * 9/2001 Robins et al. ..... 224/314
6,431,423 B1 * 8/2002 Allen et al. ..... 224/509
6,772,927 B2 * 8/2004 Bogoslofski ..... 224/324
2001/0040139 A1 * 11/2001 Dean et al. ..... 211/17
2009/0308903 A1 * 12/2009 Vigeant et al. ..... 224/431

* cited by examiner

*Primary Examiner* — Brian D Nash
(74) *Attorney, Agent, or Firm* — Rathe Lindenbaum LLP

(57) ABSTRACT

A sling system comprises a sling strap and an attachment strap. The sling strap has a first keyhole clip coupled to the sling strap. The first keyhole clip includes a first opening and a second opening smaller than the first opening in at least one dimension and in communication with the first opening. The attachment strap comprises an elastomeric body having a head extending from the body, a first neck between the head and the body, a second neck between the first neck and head and a collar between the first neck and the second neck. The first opening is larger than the head. The second opening is smaller than the head. An aperture through the body surrounds the first neck sandwiched between the collar and the body. The second opening surrounds the second neck sandwiched between the collar and the head.

22 Claims, 6 Drawing Sheets

SLING SYSTEM

CROSS-REFERENCE TO RELATED PATENT APPLICATIONS

The present application claims priority under 35 USC 119 from co-pending U.S. provisional patent application Ser. No. 61/430,158 filed on Jan. 5, 2011 by Michael M. Arajakis and entitled SLING SYSTEM, the full disclosure of which is hereby incorporated by reference.

BACKGROUND

During wildlife observation and hunting, is often beneficial to carry equipment over one's shoulder with a shoulder strap or sling system. However, existing shoulder strap or sling systems frequently require two-hands for connection or disconnection to the equipment, may damage the equipment being carried and may produce undesirable noise when used.

DETAILED DESCRIPTION OF THE EXAMPLE IMPLEMENTATIONS

Figure 1:
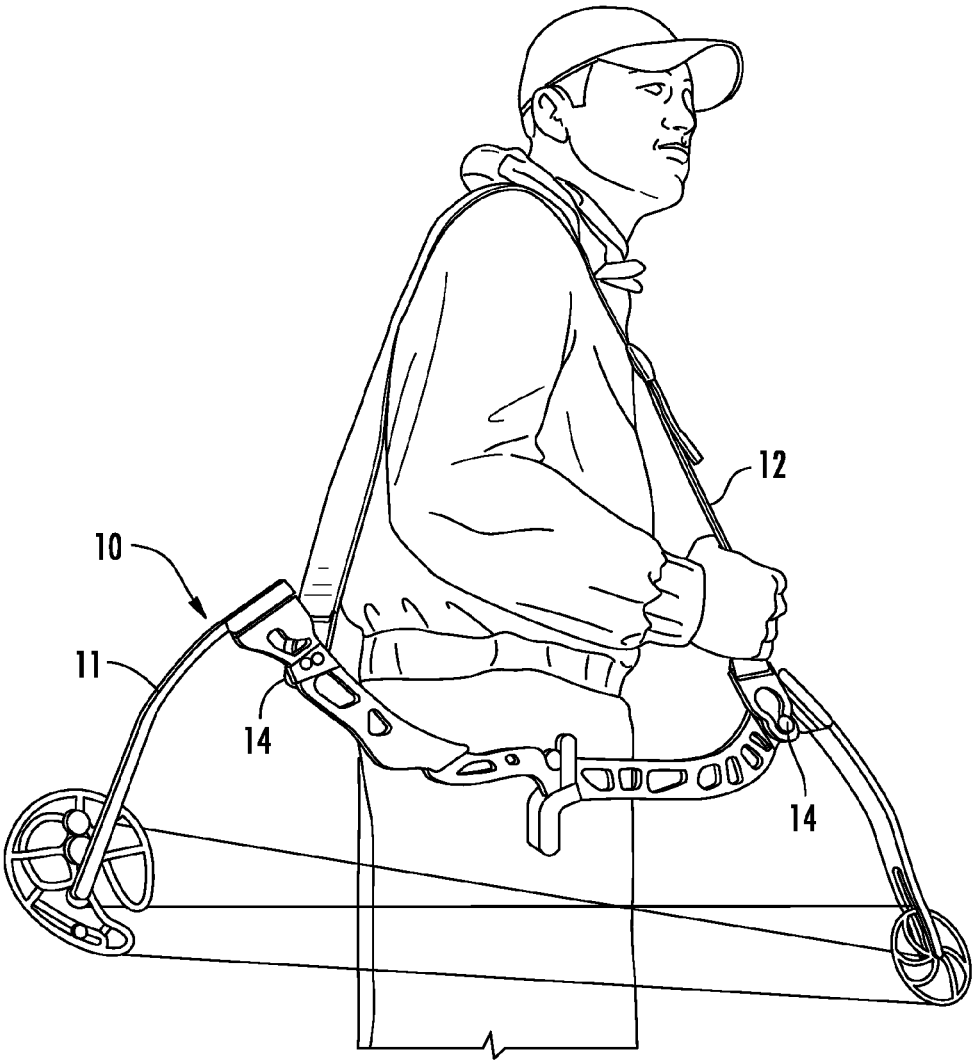
FIG. 1 is a perspective view of an example sling system in use.

FIG. 1 illustrates an example sling system 10 in use. In particular, FIG. 1 illustrates sling system 10 supported up on a shoulder of the person all connected at opposite ends to a piece of equipment, shown as an archery bow 11. Sling system 10 is configured to be easily and intuitively attached and detached from a piece of equipment while supporting the piece of equipment from one's shoulder with less damage to the piece of equipment and with less noise. Sling system 10 generally comprises sling strap assembly 12 and attachment straps 14.

Figure 2A:
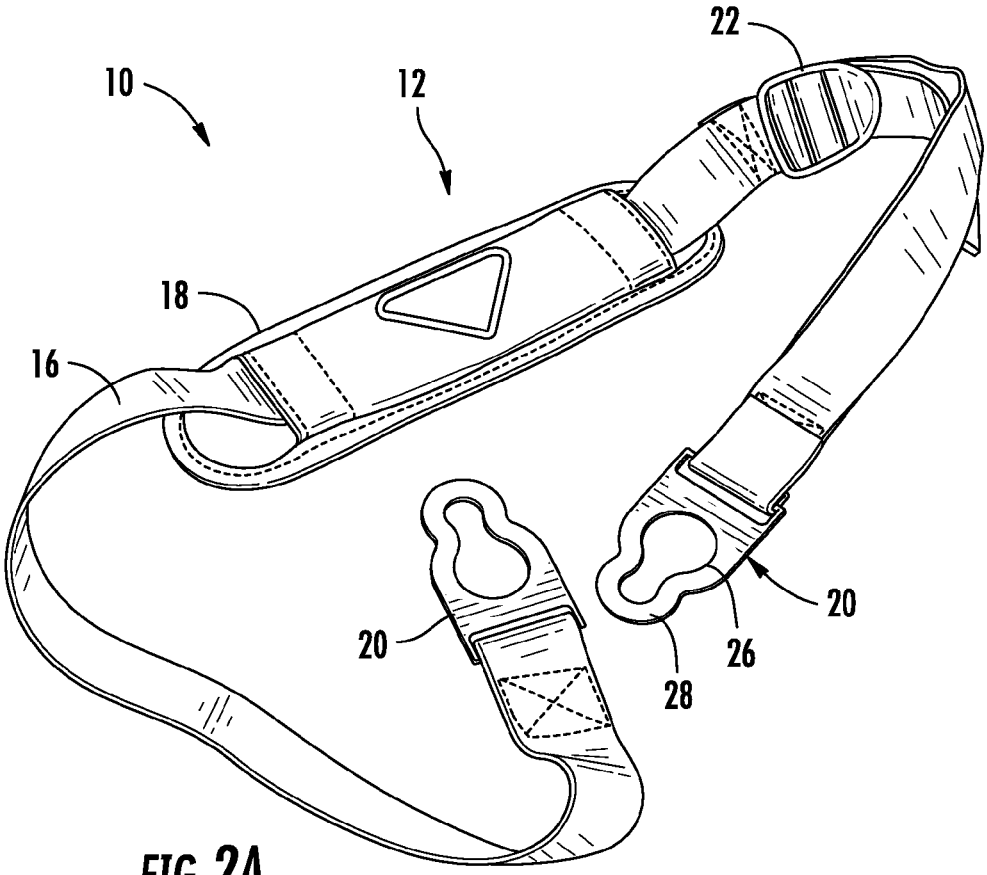
FIG. 2A is a perspective view of an example sling strap assembly of the sling system of FIG. 1.
Figure 2B:
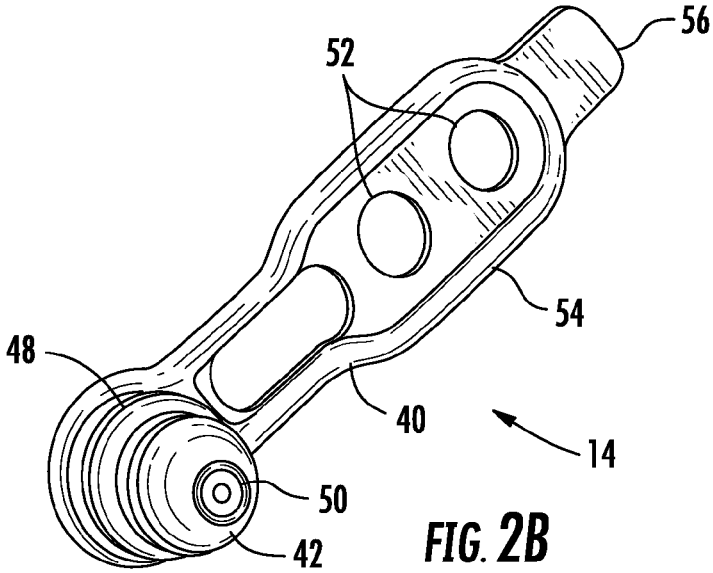
FIG. 2B is a perspective view of an example attachment strap of the sling system of FIG. 1.

FIGS. 2A and 2B illustrate sling strap assembly 12 and one of attachment straps 14, respectively, in more detail. As shown by FIG. 1, sling strap 12 is configured to be attached to attachment strap 14 at opposite ends and to extend from attachment strap 14 over and about a shoulder of a person. Sling strap assembly 12 includes sling strap 16, pad 18 and keyhole clips 20.

Sling strap 16 comprises one or more strips or straps of material, such as nylon. Sling strap 16 extends through an optional pad 18. In example embodiment, sling strap 16 includes a buckle 22 to facilitate length adjustment of sling strap 16. In other embodiments, buckle 22 may be omitted.

Keyhole clips 20 comprising clips coupled to opposite ends of sling strap 16. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

As shown by FIG. 2A, each keyhole clip 20 includes a first opening 26 and a second opening 28. Opening 28 is in communication or is connected to opening 26 and is smaller than opening 26 in at least one dimension. Although illustrated as being circular, one or both of openings 26 and 28 may have different shapes, such as slots, ovals, squares, rectangles and the like. In the example illustrated, clips 20 are formed from a rigid material such as nylon 46 and have openings 30 through which strap 16 extends and is stitched together to secure clips 20 to strap 16. In other embodiments, clips 20 are formed from other materials and may be secured to strap 16 in other manners.

Attachment strap 14 comprises a member configured to be secured to a component that is to be carried using sling strap 12. In the example illustrated, attachment strap 14 is configured to be removably and manually attached about the component without requiring tools, adhesives or additional fasteners. The term "removably" or "removable" means that attachment strap 14 may be withdrawn and separated from the component without severing, damaging or leaving adhesive remnants on the component. Attachment strap 14 is configured to allow attachment strap 14 to be manually separated or removed from the component in the above defined "removable" fashion without tools. In other embodiments, attachment strap 14 may be bonded, fastened, captured, sewn or otherwise secured or retained with respect to the component. In one embodiment, attachment strap 14 is configured to be secured with respect to a riser of a bow. In other embodiments, attachment strap 14 may be secured to other components such as backpacks, carriers, rifles (artillery), and the like.

As shown by FIGS. 2B and 4A-4C, attachment strap 14 comprises body 40, head 42, neck 44, neck 46, collar 48, insert 50, apertures 52, wall 54, handle tab 56 and post 58. Body 40 comprises elongate strap the elastomeric material having rubber-like properties. In embodiments where attachment strap 14 is to wrap about a riser of a bow, body 40 has a length between a centerline of head 42 and an outermost aperture 52 such that body 40 may be wrapped about the riser with at least the outermost aperture 52 being able to receive head 42. Because body 40 is formed from a relatively soft, compressible or elastomeric material, body 40 may be easily wrapped about a component, allowing some degree of stretching during wrapping, without scratching a component while frictionally resisting relative movement with respect to the component. In addition, body 40 may more easily conform to various shapes of a component being wrapped while dampening noise and vibration. Such dampening may be especially beneficial in applications such as hunting or wildlife observation.

Head 42 projects from one side of body 40. Neck 44 comprises a channel or groove having a diameter less than the outer diameter of head 42 and located between head 42 and body 40. Neck 46 comprises a channel or groove having a diameter less than head 42 located between head 42 and neck 44. Collar 48 comprises a ring, projection or spaced tabs having an outer diameter greater than the inner diameter of neck 44 and neck 46, wherein collar 40 extends between neck 44 and neck 46. Collar 48 separates necks 44 and 46. In some embodiments, collar 48 may be omitted. Although collar 48 and head 42 are illustrated as having generally circular cross sections, in other embodiments, one or both of collar 48 and neck 42 may alternatively comprise other shapes or configurations such as intermittent, circumferentially spaced tabs or projections.

Insert 50 comprises a member extending within each of head 42, neck 44 and neck 46. Insert 50 strengthens or rigidifies head 42, neck 46 and neck 44. Insert 50 is formed from one or more materials having a rigidity greater than the one of more materials forming head 42. Insert 50 serves as a core, backbone or spine for head 42, facilitating easier positioning of openings 52 and openings 26, 28 over head 42 and about necks 44 and 46.

Figure 5A:
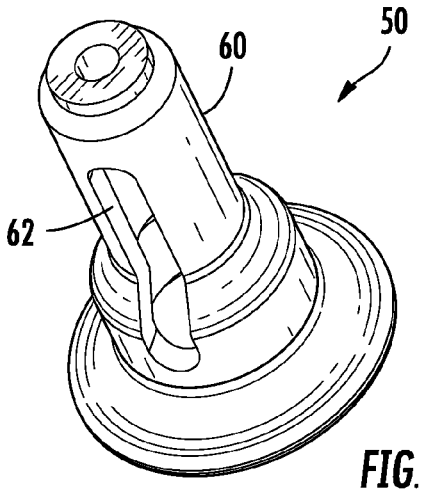
FIG. 5A is a perspective view of an example insert for the attachment strap of FIG. 4A.
Figure 5B:
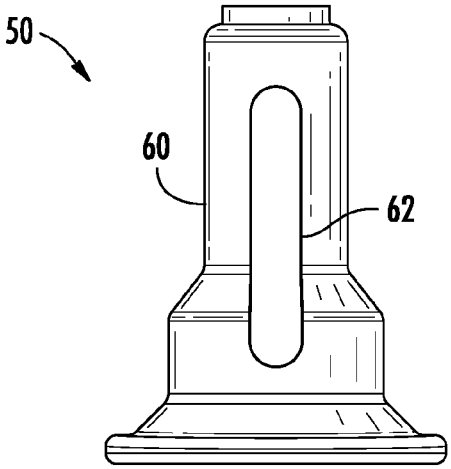
FIG. 5B is a side elevational view of the insert of FIG. 5A.
Figure 5C:
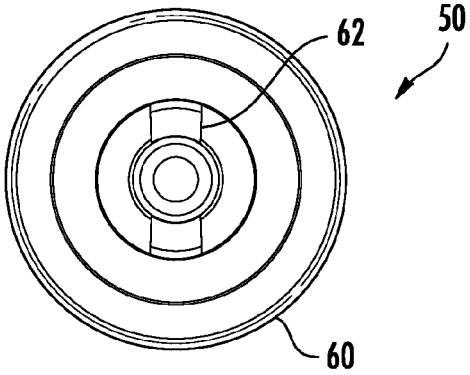
FIG. 5C is a bottom plan view of the insert of FIG. 5A.

As shown by FIGS. 5A-5C which illustrate one example of insert 50, insert 50 comprises a tubular member 60 having a hole 62. Hole 62 allows material to flow through insert 50 such that the same material may surround and encapsulate insert 50. As a result, head 42 may be over molded about insert 50, providing secure retention of head 42 with respect to insert 50 without glues or fasteners. In one embodiment, head 42, neck 44, neck 46, collar 48 and post 58 are integrally formed as a single unitary body on the same material extending through and across insert 50. As a result, post 58 is also secured to insert 50 and head 42 without glues, fasteners or the like. In other embodiments, hole 62 may be omitted, wherein post 58 may be formed from a different material and a secured to insert 50 in other manners.

Apertures 52 extend through body 40 at locations spaced from head 42. Apertures 52 are each configured or sized such that portions of body about apertures 52 surround neck 44 while being sandwiched between collar 48 and body 40. As a result, when one of apertures 52 receives neck 44, body 40 forms a loop wrapped about a component. Because body 40 includes multiple spaced apertures 52, body 40 may be securely wrapped about components having different cross-sectional dimensions. In other embodiments, attachment strap 14 may include a single aperture 52 or more than two apertures 52.

Wall 54 comprises a raised structure and projects from a same side of body 40 as head 42. Wall 54 at least partially surrounds one or both of apertures 52. Wall 54 extends on opposite sides of at least one of apertures 52. Those portions of the wall 52 on opposite sides of apertures 52 are spaced such that collar 44 may be inset or received within the cavity or depression formed between such portions of wall 54. As a result, wall 54 assists in retaining head 42 and collar 44 relative to aperture 52. Wall 54 assists in retaining body 40 with respect to collar 44. Although wall 54 is illustrated as comprising a substantially continuous wall, in other embodiments, wall 54 may comprise a plurality of spaced wall segments which collectively extending at least partially about one or more of apertures 52. In other embodiments, wall 54 may have other configurations or may be omitted.

Handle tab 56 comprises flange or tab projecting from body 40 on an opposite end of body 40 as head 42. Handle tab 56 provides a structure or surface against which a person may grip attachment strap 14 to pull and wrap attachment strap 14 about a component prior to head 42 being inserted through one of apertures 52. In other embodiments, handle tab 56 may have other configurations or may be omitted.

Post 58 comprises a projection extending away from body 40 on opposite side of body 40 as head 42. Post 58 is configured to project into a void or cavity in the component about which attachment strap 14 wraps. Post 58 assists in retaining attachment strap 14 in place with respect to the component. Post 58 inhibits rotation attachment strap 14 with respect to the component.

In the example illustrated, post 58 extends along and about a same axis 59 as head 42. As a result, head 42 may be better grasped and used to manipulate and position post 58 within a void or cavity of a component. In addition, the greater portion of a length of body 50 may be bent and wrapped about a component without interference from post 58. In other embodiments, post 58 may extend along an axis distinct from the centerline or axis of head 42.

Figure 3A:
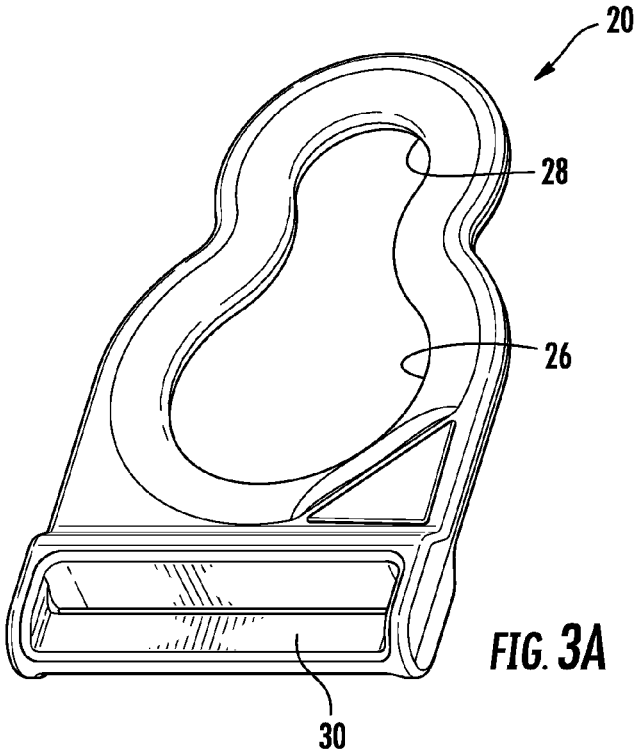
FIG. 3A is a perspective view of an example buckle of the sling strap assembly of FIG. 2A.
Figure 3B:
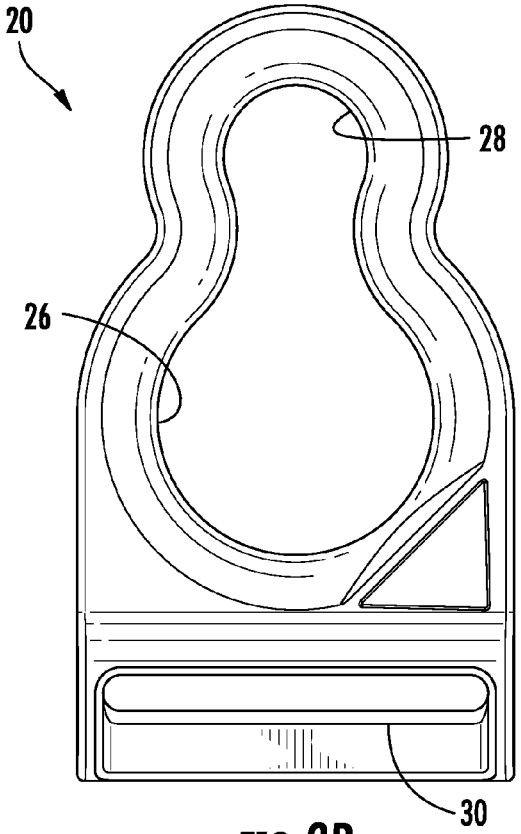
FIG. 3B is a top plan view of the buckle of FIG. 3A.
Figure 3C:
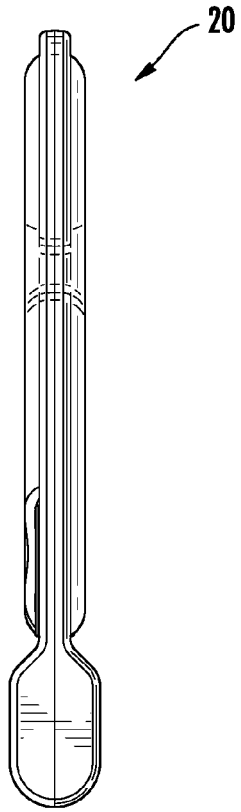
FIG. 3C is a side elevational view of the buckle of FIG. 3A.
Figure 4A:
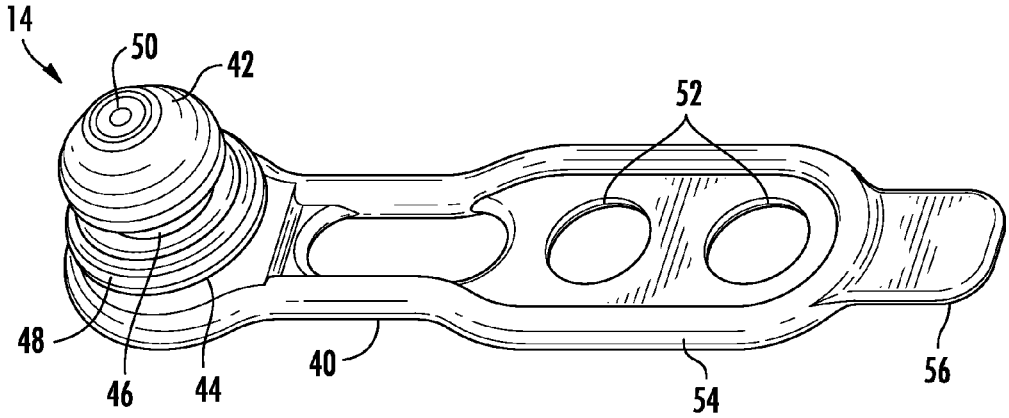
FIG. 4A is a perspective view of the attachment strap of FIG. 2B.
Figure 4B:
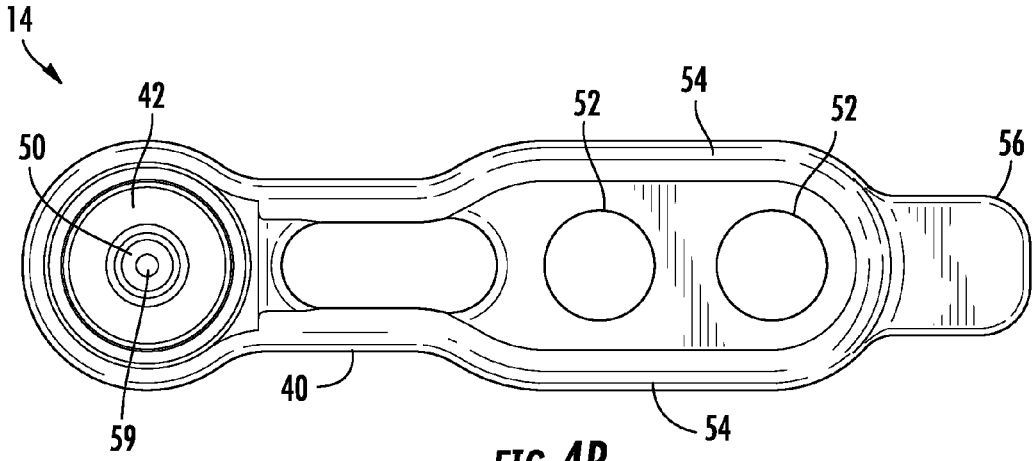
FIG. 4B is a top plan view of the attachment strap of FIG. 4A.
Figure 4C:
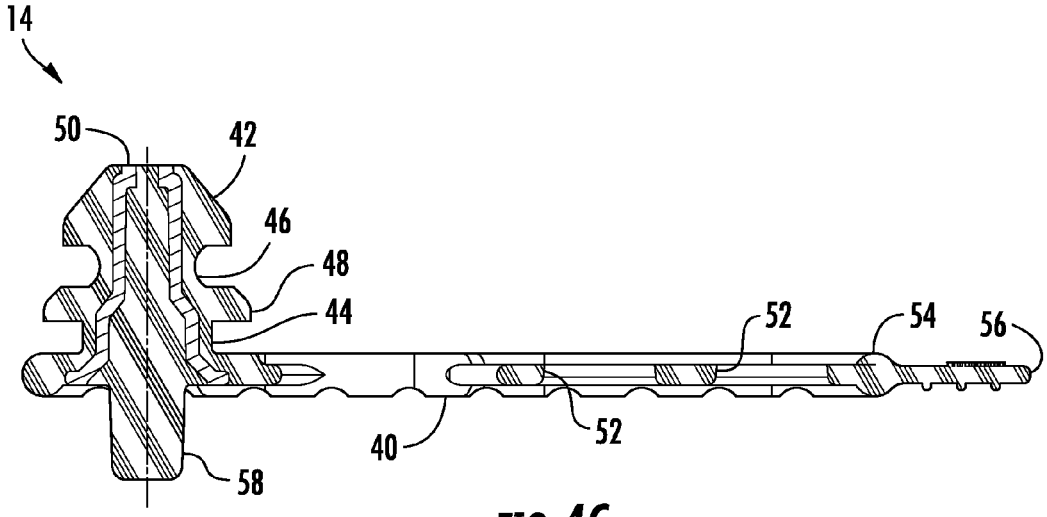
FIG. 4C is a sectional view of the attachment strap of FIG. 4A.

In the example illustrated, post 58 comprises a soft rubber-like elastomeric material. As a result, post 58 can flex or deform during insertion into the cavity or void. Moreover, post 58 is less likely to scratch or damage the component, provides enhanced frictional contact (a higher coefficient of friction) with respect to the component and reduces vibration and noise that might result from relative movement between post 58 and the component. In one example embodiment, post 58 is integrally formed as a single unitary body with head 42, neck 44 and neck 46. In the example illustrated in FIG. 3C, post 58 is formed from a material that extends through hole 62 and also forms head 42 so as to be securely fixed to insert 50. In other embodiments, post 58 may comprise a separate component received within or attached to insert 50. In some embodiments, post 58 may be omitted.

In the example illustrated, attachment strap 14 is entirely formed as a single integral unitary body of a homogenous single elastomeric or rubber-like material but for insert 50 about which the material is over molded. As a result, fabrication of attachment strap 14 is less complex and less expensive. In other embodiments, attachment strap 14 may be formed from multiple materials and multiple elements fastened, glued, bonded or welded together.

Figure 6A:
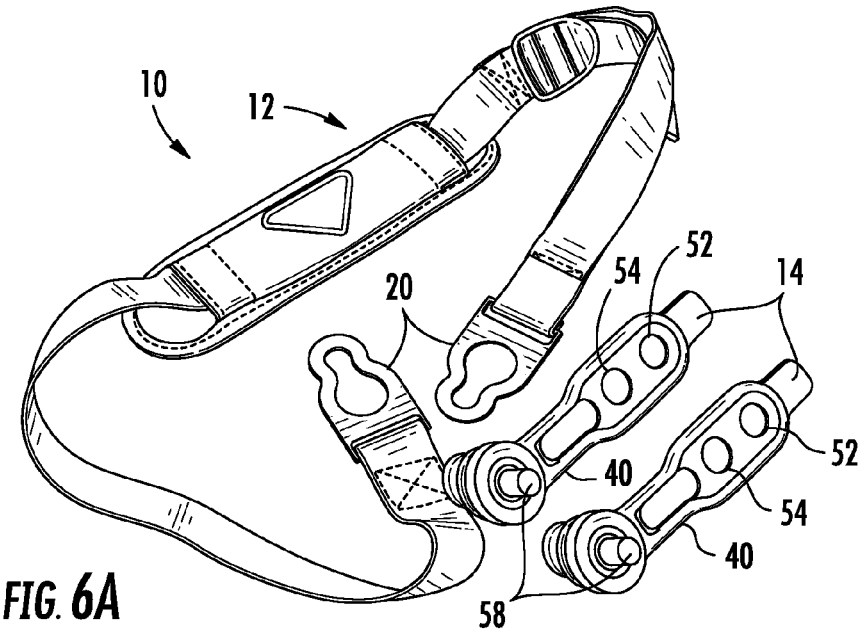
FIG. 6A is a perspective view of the sling system of FIG. 1.
Figure 6B:
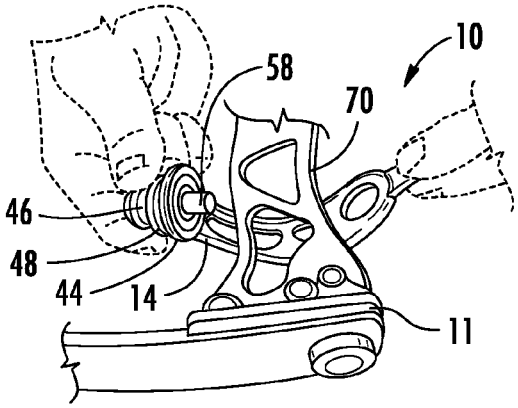
FIGS. 6B-6D are perspective views illustrating attachment of an attachment strap to an example piece of equipment to be carried by the sling system.
Figure 6C:
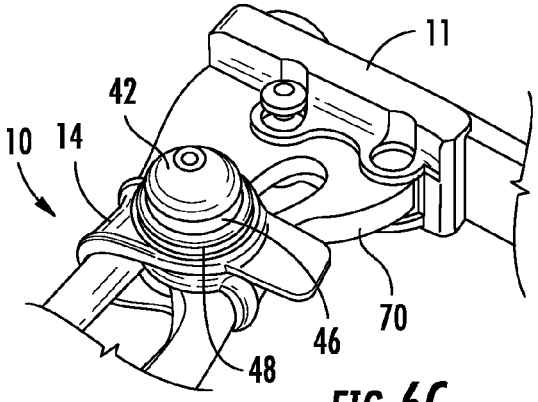

FIGS. 6A-6C illustrate use of one example of sling system 10. As shown in FIG. 6A, sling system 14 includes three assembled components: two attachment straps 14 and one swing strap assembly 12. As shown in FIG. 6B, attachment strap 14 is wrapped about a riser 70 a bow 11. In particular, the person grasps handle tab 56 while holding head 42 while bending body 40 about the component (riser 70). Once wrapped, a person passes head 42, neck 46 and collar 48 through the selected opening 52 such that the selected opening 52 (portions of body 40 about opening 52) surrounds neck 44 and is captured or sandwiched between collar 48 and body 40 as shown in FIG. 6C. In this arrangement, attachment 14 may be left in place on the component (bow 11) even when strap assembly 12 is not being used. The second attachment strap 14 is attached or mounted to the component in a similar fashion.

Figure 6D:
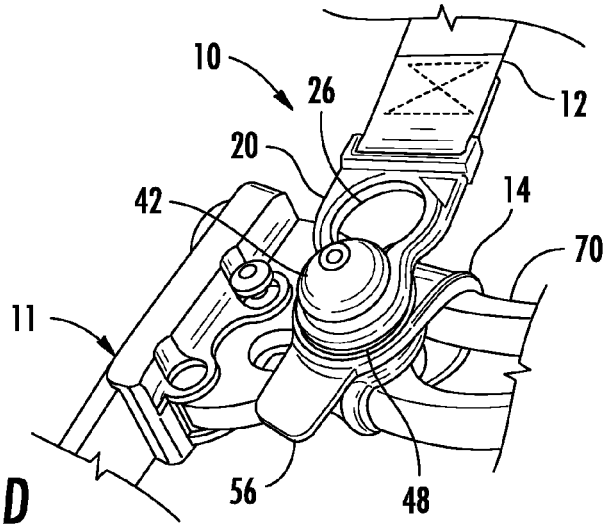

As shown by FIG. 6D, the person then attaches are connects sling strap assembly 12 to the two attachment straps 14. In particular, the person locates opening 26 of one of keyhole clips 20 opposite to head 42. Head 42 is passed through opening 26 such an opening 26 surrounds and is opposite to neck 46. Thereafter, the associated keyhole clip 20 and head 42 are moved laterally with respect to one another such that neck 46 is moved into the smaller opening 28 (shown in FIG. 2) such that opening 28 (or portions of clip 20 about opening 28) surround neck 46 and are sandwiched between head 42 and collar 48. In this manner, the clip 20 fills the annular void about neck 46 to assist in retaining portions of body 40 about aperture 52 in the annular void about neck 44. The second clip 20 of sling strap assembly 12 is connected to the second attachment strap 14 in a similar manner.

Although illustrated as being used with a component comprising a bow, sling system 10 maybe uses other components, such as artillery, backpacks or various carriers. Although illustrated as having attachment straps 14 removably wrapped about a component, sling system 10 may alternatively employ attachment straps 14 which are more permanently affixed to the component such as by stitching, welding, molding or fastening.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising a combined sling strap/attachment strap system, the system comprising:

a sling strap having a first end and a second end;

a first keyhole clip coupled to the sling strap at the first end, the first keyhole clip including a first opening and a second opening smaller than the first opening in at least one dimension and in communication with the first opening; and an attachment strap comprising:

an elastomeric body having a length;

a head extending from the body;

a first neck between the head and the body;

a second neck between the first neck and head;

a collar between the first neck and the second neck, wherein the first opening is larger than the head and wherein the second opening is smaller than the head; and an aperture through the body, wherein the aperture is configured to surround the first neck sandwiched between the collar and the body and wherein the second opening is configured to surround the second neck sandwiched between the collar and the head.

2. The apparatus of claim 1 further comprising a plurality of apertures including the aperture, through the body, wherein each of the plurality of apertures is configured to surround the first neck sandwiched between the collar and the body.

3. The apparatus of claim 1, wherein the head projects from a first side of the body and wherein the elastomeric strap further comprises a post projecting from a second side of the body.

4. The apparatus of claim 3, wherein the post and the head symmetrically extend about a same axis substantially perpendicular to the body.

5. The apparatus of claim 4 wherein the post and the head are integrally formed as a single unitary body.

6. The apparatus of claim 5, wherein the post in the head are formed from a first material having a first stiffness and wherein the attachment strap further comprising insert within the head, the first neck and the second neck, the insert having a second stiffness greater than the first stiffness.

7. The apparatus of claim 6, wherein the insert encircles the axis and includes at least one hole through which the first material of the post and the head extends such that the post and the head are integrally formed as a single unitary body.

8. The apparatus of claim 1 further comprising a perimeter wall projecting from the body on opposite sides of the aperture, the perimeter wall configured such that the head is receivable against the body within the perimeter wall.

9. The apparatus of claim 1 further comprising a handle to projecting from the body on an end of the elastomeric body opposite the head.

10. The apparatus of claim 1 further comprising:

a second keyhole clip coupled to the sling strap at the second end, the first keyhole clip including a third opening and a fourth opening smaller than the third opening in at least one dimension and in communication with the third opening; and a second attachment strap comprising:

a second elastomeric body having a length;

a second head extending from the second body;

a third neck between the second head and the second body;

a fourth neck between the third neck and the second head;

a second collar between the third neck and the fourth neck, wherein the third opening is larger than the second head and wherein the third opening is smaller than the second head; and a second aperture through the second body, wherein the second aperture is configured to surround the third neck sandwiched between the second collar and the second body and wherein the fourth opening is configured to surround the fourth neck sandwiched between the second collar and the second head.

11. A bow sling system comprising a combined sling strap/attachment strap system, the system comprising:

a sling strap having a first end and a second end;

a first keyhole clip coupled to the sling strap at the first end, the first keyhole clip including a first opening and a second opening smaller than the first opening in at least one dimension and in communication with the first opening; and an attachment strap comprising:

an elastomeric body having a length sufficient to wrap about a riser of a bow;

a head extending from the body;

a first neck between the head and the body;

a second neck between the first neck and head;

a collar between the first neck and the second neck, wherein the first opening is larger than the head and wherein the second opening is smaller than the head; and an aperture through the body, wherein the aperture is configured to surround the first neck sandwiched between the collar and the body and wherein the second opening is configured to surround the second neck sandwiched between the collar and the head.

12. The bow sling system of claim 11 further comprising a plurality of apertures including the aperture, through the body, wherein each of the plurality of apertures is configured to surround the first neck sandwiched between the collar and the body.

13. The bow sling system of claim 11, wherein the head projects from a first side of the body and wherein the elastomeric strap further comprises a post projecting from a second side of the body.

14. The bow sling system of claim 13, wherein the post and the head symmetrically extend along and about a same axis substantially perpendicular to the body.

15. The bow sling system of claim 14 wherein the post and the head are integrally formed as a single unitary body.

16. The bow sling system of claim 15, wherein the post in the head are formed from a first material having a first stiffness and wherein the attachment strap further comprising insert within the head, the first neck and the second neck, the insert having a second stiffness greater than the first stiffness.

17. The bow sling system of claim 16, wherein the insert encircles the axis and includes at least one hole through which the first material of the post and the head extends such that the post and the head are integrally formed as a single unitary body.

18. The bow sling system of claim 13, further comprising a bow having a riser with a void, wherein the post is received within the void.

19. The bow sling system of claim 11 further comprising a perimeter wall projecting from the body on opposite sides of the aperture, the perimeter wall configured such that the head is receivable against the body within the perimeter wall.

20. The bow sling system of claim 11 further comprising a handle to projecting from the body on an end of the elastomeric body opposite the head.

21. The bow sling system of claim 11 further comprising a bow having a riser.

22. The bow sling system of claim 11 further comprising:

a second keyhole clip coupled to the sling strap at the second end, the first keyhole clip including a third opening and a fourth opening smaller than the third opening in at least one dimension and in communication with the third opening; and a second attachment strap comprising:

a second elastomeric body having a length;

a second head extending from the second body;

a third neck between the second head and the second body;

a fourth neck between the third neck and the second head;

a second collar between the third neck and the fourth neck, wherein the third opening is larger than the second head and wherein the third opening is smaller than the second head; and a second aperture through the second body, wherein the second aperture is configured to surround the third neck sandwiched between the second collar and the second body and wherein the fourth opening is configured to surround the fourth neck sandwiched between the second collar and the second head.

* * * * *